US012256835B1

(12) United States Patent
Wei

(10) Patent No.: US 12,256,835 B1
(45) Date of Patent: Mar. 25, 2025

(54) STORAGE CABINET

(71) Applicant: GINUP INTERNATIONAL TRADING INC, Newark, DE (US)

(72) Inventor: Hongli Wei, Wuhan (CN)

( * ) Notice: Subject to any disclaimer, the term of this patent is extended or adjusted under 35 U.S.C. 154(b) by 0 days.

(21) Appl. No.: 18/786,400

(22) Filed: Jul. 26, 2024

(30) Foreign Application Priority Data

Jun. 21, 2024 (CN) ..... 202421441678.9

(51) Int. Cl.
*A47B 47/00* (2006.01)

(52) U.S. Cl.
CPC .. *A47B 47/0075* (2013.01); *A47B 2220/0055* (2013.01)

(58) Field of Classification Search
CPC ..... A47B 47/0075; A47B 2220/0055
USPC ..... 312/257.1, 258, 262
See application file for complete search history.

(56) References Cited

U.S. PATENT DOCUMENTS 442,664 A * 12/1890 Elsner
2,934,389 A * 4/1960 Krey ..... A47B 43/02 312/262
3,583,781 A * 6/1971 Yamawaki ..... A47B 3/00 312/258
4,836,626 A * 6/1989 Taylor ..... A47B 47/03 312/263
6,113,203 A * 9/2000 Chen ..... B25H 3/00 312/258
6,722,750 B2 * 4/2004 Chan ..... A47B 43/00 312/258
6,948,787 B2 * 9/2005 McBrayer, III ..... A47B 43/00 312/258
7,464,999 B2 * 12/2008 Quinn ..... A47B 43/00 312/258
2017/0282349 A1 * 10/2017 Zhao ..... A47B 81/00
2018/0110331 A1 * 4/2018 Mack ..... A47B 47/025
2021/0066971 A1 * 3/2021 Lim ..... A47B 47/0091

* cited by examiner

*Primary Examiner* — James O Hansen

(57) ABSTRACT

The present disclosure provides a storage cabinet of which a cabinet body is enclosed by a rear back plate, a left plate, a right plate, a cabinet door and a door frame; and a top plate is located in a top opening of the cabinet body and closes the top opening, and a bottom plate is located in a bottom opening of the cabinet body and closes the bottom opening. The present disclosure can improve the mounting efficiency.

9 Claims, 11 Drawing Sheets

STORAGE CABINET

TECHNICAL FIELD

The present disclosure relates to a cabinet, and in particular, to a storage cabinet.

BACKGROUND OF THE INVENTION

At present, for metal safe deposit cabinets in the market, such as safe deposit boxes, gun cabinets, filing cabinets, and tool boxes, cabinet bodies mainly use integral welded structures, and some cabinet bodies use boltable combined structures.

SUMMARY OF THE INVENTION

Embodiments of the present disclosure provide a storage cabinet, in order to solve the problems existing in related art. The technical solution thereof is described as follows.

An embodiment of the present disclosure provides a storage cabinet, comprising:

- a door frame, a first engagement portion being provided on each of the left side and the right side of the door frame;
- a cabinet door, the cabinet door being rotatably provided on the door frame;
- a left plate, a second engagement portion being provided on the front side of the left plate, and the second engagement portion being engaged with the first engagement portion on the left side of the door frame so as to connect the left plate to the door frame;
- a right plate, a third engagement portion being provided on the front side of the right plate, and the third engagement portion being engaged with the first engagement portion on the right side of the door frame so as to connect the right plate to the door frame;
- a rear back plate, the rear back plate being located between the rear side of the left plate and the rear side of the right plate, the left side of the rear back plate and the rear side of the left plate being connected together by means of a first hinge, the right side of the rear back plate and the rear side of the right plate being connected together by means of a second hinge, and the rear back plate, the left plate, the right plate, the cabinet door and the door frame enclosing a cabinet body;
- a top plate, the top plate being located in a top opening of the cabinet body and closing the top opening, and the top plate being connected to the cabinet body by means of a first fastener; and
- a bottom plate, the bottom plate being located in a bottom opening of the cabinet body and closing the bottom opening, and the bottom plate being connected to the cabinet body by means of a second fastener.

In an implementation, the bottom plate and the rear back plate are connected together by means of a third hinge.

In an implementation, the third hinge is located outside the cabinet body such that the bottom plate can be turned in a direction approaching an inner side surface of the rear back plate; and

- a limiting pallet is provided at the bottom of the cabinet body and is disposed opposite to the third hinge, the limiting pallet supports an end of the bottom plate facing away from the third hinge, and the limiting pallet is connected to the bottom plate by means of the second fastener.

In an implementation, the first hinge and the second hinge are both located inside the cabinet body such that both the left plate and the right plate can be turned in a direction approaching an inner side surface of the rear back plate.

In an implementation, a front connecting plate is further provided on each of the left side and the right side of a back surface of the door frame, and each first engagement portion is located on the corresponding front connecting plate;

- a first left connecting plate is further provided on the front side of the left plate, and the second engagement portion is located on the first left connecting plate;
- when the left plate is connected to the door frame, the first left connecting plate is opposite to and abuts against the front connecting plate located on the left side of the door frame;
- a first right connecting plate is further provided on the front side of the right plate, and the third engagement portion is located on the first right connecting plate; and
- when the right plate is connected to the door frame, the first right connecting plate is opposite to and abuts against the front connecting plate located on the right side of the door frame.

In an implementation, a first extension plate is further provided on the front side of the left plate, a first end of the first extension plate is provided on an end of the first left connecting plate facing away from the left plate, and a second end of the first extension plate extends in a direction approaching the door frame.

In an implementation, a second extension plate is further provided on the front side of the right plate, a first end of the second extension plate is provided on an end of the first right connecting plate facing away from the right plate, and a second end of the second extension plate extends in a direction approaching the door frame.

In an implementation, the rear side of the left plate is provided with a second left connecting plate and a third extension plate, the second left connecting plate is perpendicular to the left plate, the third extension plate is provided on an end of the second left connecting plate remote from the left plate, and the third extension plate is perpendicular to the second left connecting plate;

- a first rear connecting plate and a fourth extension plate are provided on the left side of the rear back plate, the first rear connecting plate is opposite to and abuts against the second left connecting plate, the fourth extension plate is provided on the first rear connecting plate, and the fourth extension plate and the third extension plate are provided on two sides of the second left connecting plate and the first rear connecting plate respectively; and
- a first side plate of the first hinge and the third extension plate are opposite to each other and connected together, and a second side plate of the first hinge and the fourth extension plate are opposite to each other and connected together.

In an implementation, a second right connecting plate and a fifth extension plate are provided on the rear side of the right plate, the second right connecting plate is perpendicular to the right plate, the fifth extension plate is provided at an end of the second right connecting plate remote from the right plate, and the fifth extension plate is perpendicular to the second right connecting plate;

- a second rear connecting plate and a sixth extension plate are provided on the right side of the rear back plate, the second rear connecting plate is opposite to and abuts against the second right connecting plate, the sixth extension plate is provided on the second rear connecting plate, and the sixth extension plate and the fifth extension plate are provided on two sides of the second right connecting plate and the second rear connecting plate respectively; and a first side plate of the second hinge and the fifth extension plate are opposite to each other and connected together, and a second side plate of the second hinge and the sixth extension plate are opposite to each other and connected together.

In an implementation, a plurality of first fasteners are provided;

the top plate is provided with a first connecting lug, a second connecting lug, and a third connecting lug;

at least one of the first fasteners connects the first connecting lug, the third extension plate and the fourth extension plate together;

at least one of the first fasteners connects the second connecting lug, the fifth extension plate and the sixth extension plate together; and at least one of the third connecting lug and the door frame are connected together.

In an implementation, a plurality of first fasteners are provided;

the top plate is provided with a first connecting lug, a second connecting lug, and a third connecting lug;

at least one of the first fasteners connects the first connecting lug, the second left connecting plate and the first rear connecting plate together;

at least one of the first fasteners connects the second connecting lug, the second right connecting plate and the second rear connecting plate together; and at least one of the first fasteners connects the third connecting lug and the door frame together.

The above description is merely presented for the purpose of the specification, and is not intended to limit the present disclosure in any way. In addition to the above illustrative aspects, implementations and features, further aspects, implementations and features of the present disclosure will become readily apparent with reference to the accompanying drawings and the following detailed description.

BRIEF DESCRIPTION OF THE DRAWINGS

In figures, the same reference signs denote the same or similar components or elements throughout multiple figures unless otherwise specified. These figures are not necessarily drawn to scale. It should be understood that these figures depict only some implementations according to the present disclosure and are not to be construed as limiting the scope of the present disclosure.

LIST OF REFERENCE SIGNS

Figure 1:
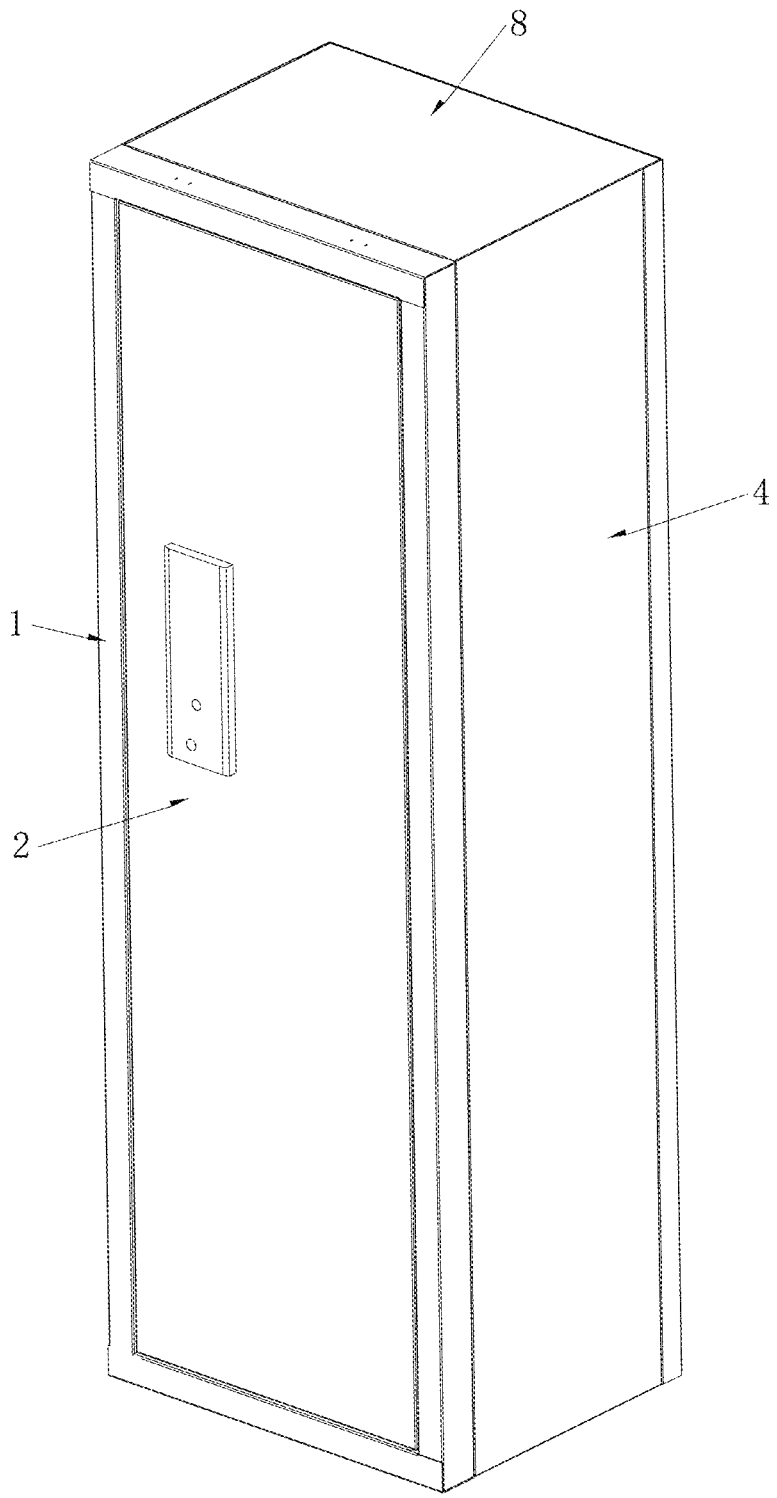
FIG. 1 is a structural perspective schematic diagram of a storage cabinet according to the present disclosure from a first perspective.
Figure 2:
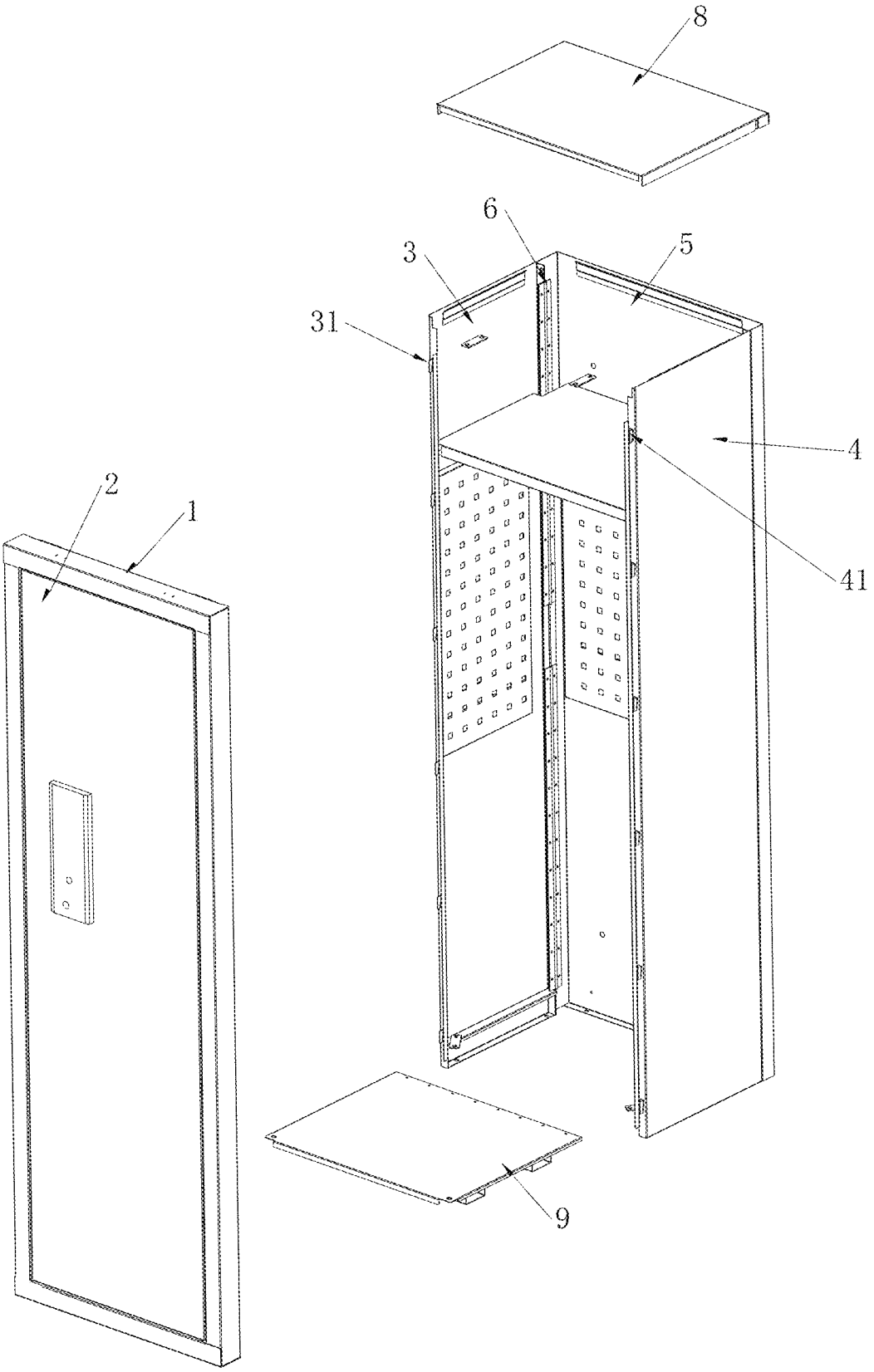
FIG. 2 is an exploded view of the storage cabinet according to the present disclosure.

1. Door frame; 11. First engagement portion; 12. Front connecting plate; 2. Cabinet door; 3. Left plate; 31. Second engagement portion; 32. First left connecting plate; 33. First extension plate; 34. Second left connecting plate; 35. Third extension plate; 4. Right plate; 41. Third engagement portion; 42. First right connecting plate; 43. Second extension plate; 44. Second right connecting plate; 45. Fifth extension plate; 5. Rear back plate; 51. First rear connecting plate; 52. Fourth extension plate; 53. Second rear connecting plate; 54. Sixth extension plate; 6. First hinge; 7. Second hinge; 8. Top plate; 81. First connecting lug; 82. Second connecting lug; 83. Third connecting lug; 9. Bottom plate; 10. Third hinge; 20. Limiting pallet.

DETAILED DESCRIPTION OF THE INVENTION

Only some exemplary embodiments will be briefly described below. As can be appreciated by those skilled in the art, modifications may be made to the described embodiments in various ways without departing from the spirit or scope of the present disclosure. Therefore, the drawings and the description are considered as exemplary in nature rather than limiting.

A cabinet body in the prior art, which is of an integrally welded structure, is non-detachable, and thus has a large size and high transportation costs. Although a cabinet body of a boltable combined structure in the prior art has lower transportation costs, the cabinet body has higher site mounting costs, and it is also required to mount a plurality of connecting bolts, causing cumbersome mounting and a low mounting efficiency.

Referring to FIGS. 1-11, a storage cabinet according to a preferred implementation of the present disclosure is illustrated. The storage cabinet comprises:

a door frame 1, a first engagement portion 11 being provided on each of the left side and the right side of the door frame 1;

a cabinet door 2, the cabinet door 2 being rotatably provided on the door frame 1;

a left plate 3, a second engagement portion 31 being provided on the front side of the left plate 3, and the second engagement portion 31 being engaged with the first engagement portion 11 on the left side of the door frame 1 so as to connect the left plate 3 to the door frame 1;

a right plate 4, a third engagement portion 41 being provided on the front side of the right plate 4, and the third engagement portion 41 being engaged with the first engagement portion 11 on the right side of the door frame 1 so as to connect the right plate 4 to the door frame 1;

a rear back plate 5, the rear back plate 5 being located between the rear side of the left plate 3 and the rear side of the right plate 4, the left side of the rear back plate 5 and the rear side of the left plate 3 being connected together by means of a first hinge 6, the right side of the rear back plate 5 and the rear side of the right plate 4 being connected together by means of a second hinge 7, and the rear back plate 5, the left plate 3, the right plate 4, the cabinet door 2 and the door frame 1 enclose a cabinet body;

a top plate 8, the top plate 8 being located in a top opening of the cabinet body and closing the top opening, and the top plate 8 being connected to the cabinet body by means of a first fastener (not shown in figures); and a bottom plate 9, the bottom plate 9 being located in a bottom opening of the cabinet body and closing the bottom opening, and the bottom plate 9 being connected to the cabinet body by means of a second fastener (not shown in figures).

The storage cabinet of the present disclosure comprises the door frame 1, the cabinet door 2, the left plate 3, the right plate 4, the rear back plate 5, the top plate 8 and the bottom plate 9. During assembly, the left side of the rear back plate 5 and the rear side of the left plate 3 are first connected together by means of the first hinge 6, the right side of the rear back plate 5 and the rear side of the right plate 4 are then connected together by means of the second hinge 7, the left side of the door frame 1 and the front side of the left plate 3 are engaged by means of the corresponding first engagement portion 11 and the corresponding second engagement portion 31, the right side of the door frame 1 and the front side of the right plate 4 are engaged by means of the corresponding first engagement portion 11 and the corresponding third engagement portion 41, the top plate 8 is mounted on the top of the cabinet body by means of the first fastener, the bottom plate 9 is later mounted on the bottom of the cabinet body by means of the second fastener, and finally the cabinet door 2 is rotatably mounted on the door frame 1, so that the assembly is completed. By replacing fasteners with an engagement structure composed of the first engagement portion 11 and the second engagement portion 31, an engagement structure composed of the first engagement portion 11 and the third engagement portion 41, the first hinge 6 and the second hinge 7, the number of the fasteners used is reduced, the assembly is more convenient and faster, and thus the assembly efficiency can be improved. In addition, during packaging, the door frame 1, the cabinet door 2, the left plate 3, the right plate 4, the rear back plate 5, the top plate 8, and the bottom plate 9 can be placed in a packaging box in a stacked manner, because that the left plate 3 and the rear back plate 5, and the right plate 4 and the rear back plate 5 are both connected together by means of the hinge; the left plate 3 and the door frame 1, and the right plate 4 and the door frame 1 are both connected together by means of the engagement structure; and the top plate 8 and the cabinet body, and the bottom plate 9 and the cabinet body are both connected together by means of the fastener. By means of the stacked placement, the packaging size can be reduced, an occupied space can be small, and the transportation costs can be reduced. Moreover, since the top plate 8 and the bottom plate 9 are each connected to the cabinet body by means of the fastener, the top plate 8 and the bottom plate 9 can each be reliably connected to the cabinet body together, the overall strength of the storage cabinet can be enhanced, and the structural stability can be higher.

Figure 10:
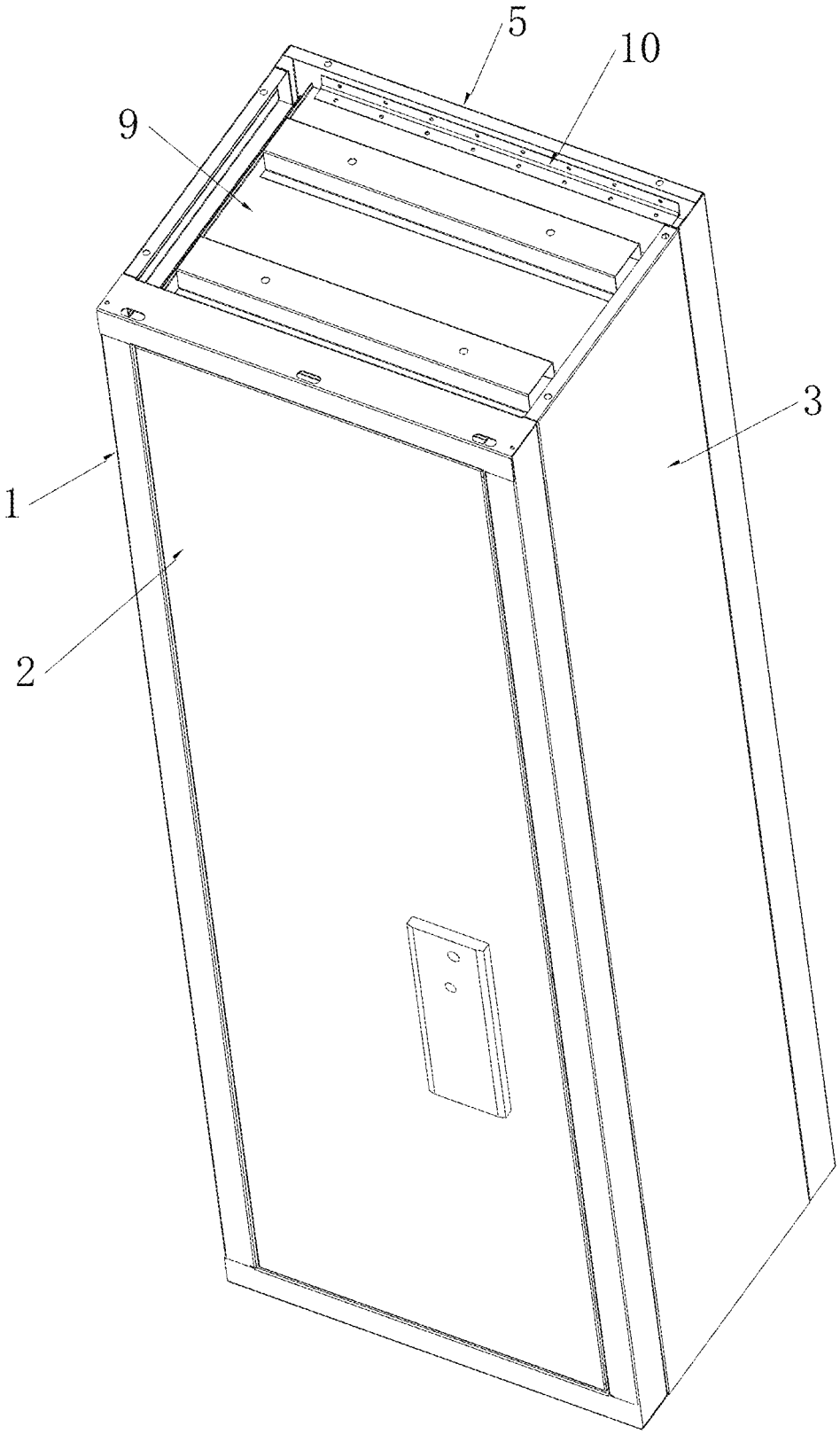
FIG. 10 is a structural perspective schematic diagram of the storage cabinet according to the present disclosure from a second perspective.

Referring to FIG. 10, in an implementation, the bottom plate 9 is connected to the rear back plate 5 by means of a third hinge 10 to decrease the number of the second fasteners used, so that the mounting efficiency of the bottom plate 9 can be improved, and thus the assembly efficiency of the storage cabinet can be further improved.

Referring to FIG. 10, in an implementation, the third hinge 10 is located outside the cabinet body such that the bottom plate 9 can be turned in a direction approaching an inner side surface of the rear back plate 5. In this way, when the left plate 3, the right plate 4 and the door frame 1 are mounted, the bottom plate 9 can be turned in a direction approaching the inner side surface of the rear back plate 5, the bottom plate 9 is then located on a side close to the inner side surface of the rear back plate 5 without hindering the mounting of the left plate 3, the right plate 4 and the door frame 1, making the mounting more convenient and faster. Furthermore, when the storage cabinet is disassembled, the bottom plate 9 and the rear back plate 5 can be stacked together by allowing the bottom plate 9 to be located on the side close to the inner side surface of the rear back plate 5, and the size can be reduced without removing the bottom plate 9 from the rear back plate 5, so that the disassembly efficiency and subsequent reassembly efficiency can be improved, and the storage cabinet is more flexible and convenient and faster.

Figure 11:
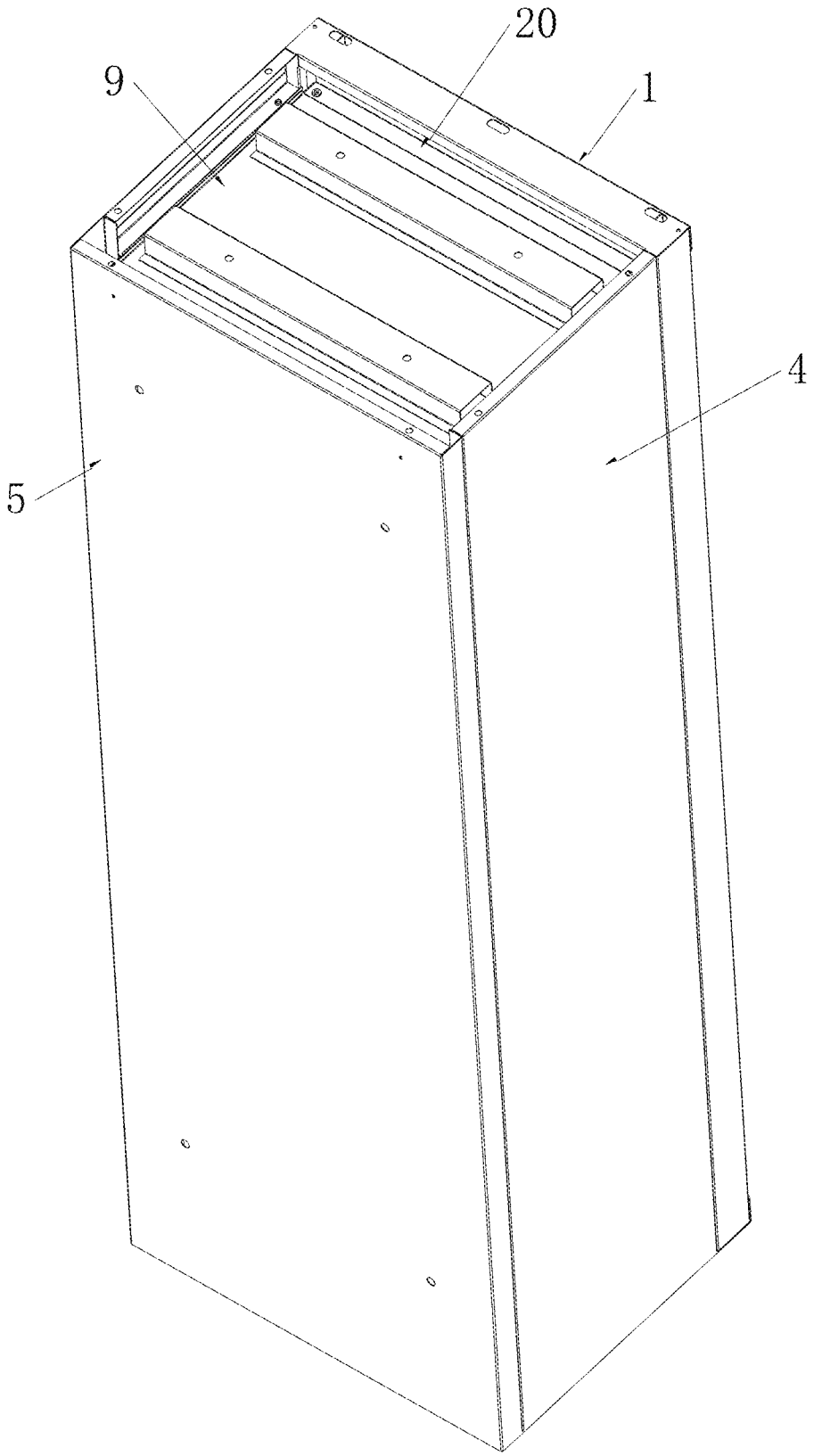
FIG. 11 is a structural perspective schematic diagram of the storage cabinet according to the present disclosure from a third perspective.

Referring to FIG. 11, a limiting pallet 20 is provided at the bottom of the cabinet body, the limiting pallet 20 being provided opposite to the third hinge 10, the limiting pallet 20 supports an end of the bottom plate 9 facing away from the third hinge 10, the limiting pallet 20 is connected to the bottom plate 9 by means of the second fastener to limit the end of the bottom plate 9, facing away from the third hinge 10, from leaving the bottom opening of the cabinet body downward, and meanwhile, the bottom plate 9 is reliably fixed to the cabinet body, so that the structural reliability is higher.

In an implementation, the first hinge 6 and the second hinge 7 are both located in the cabinet body, such that both the left plate 3 and the right plate 4 can be turned in a direction approaching the inner side surface of the rear back plate 5. Thus, when the storage cabinet is disassembled, the left plate 3 and the rear back plate 5 can be stacked together by allowing the left plate 3 to be located on the side close to the inner side surface of the rear back plate 5, and the right plate 4 and the rear back plate 5 can be stacked together by allowing the right plate 4 to be located on the side close to the inner side surface of the rear back plate 5, so that the size can be reduced without removing the left plate 3 and the right plate 4 from the rear back plate 5, the disassembly efficiency and subsequent reassembly efficiency can be improved, and the storage cabinet is more flexible and convenient and faster.

In an implementation, each of the first engagement portion 11, the second engagement portion 31, the third engagement portion 41, the first hinge 6, the second hinge 7, the first fastener and the second fastener is located inside the cabinet body, so that the corresponding engagement portions, the corresponding hinges and the corresponding fasteners are hidden inside the storage cabinet, and the corresponding engagement portions, the corresponding hinges and the corresponding fasteners are prevented from being damaged maliciously due to the exposure thereof outside the storage cabinet, the safety performance of the storage cabinet can be improved, and an anti-theft effect is achieved.

In an implementation, the first engagement portion 11 is a hole, and each of the second engagement portion 31 and the third engagement portion 41 is a catch. By fitting the catches with the corresponding holes, the left plate 3 and the door frame 1, and the right plate 4 and the door frame 1 can be respectively connected tightly to form the cabinet body of a firmer and more stable structure, and the overall structural strength of the storage cabinet can be further enhanced.

In other implementations, the first engagement portion 11 is a catch, and each of the second engagement portion 31 and the third engagement portion 41 is a hole.

In other implementations, each of the first engagement portion 11, the second engagement portion 31, and the third engagement portion 41 is a catch.

In an implementation, each of the first fastener and the second fastener is a connector, such as a bolt or a screw.

Figure 3:
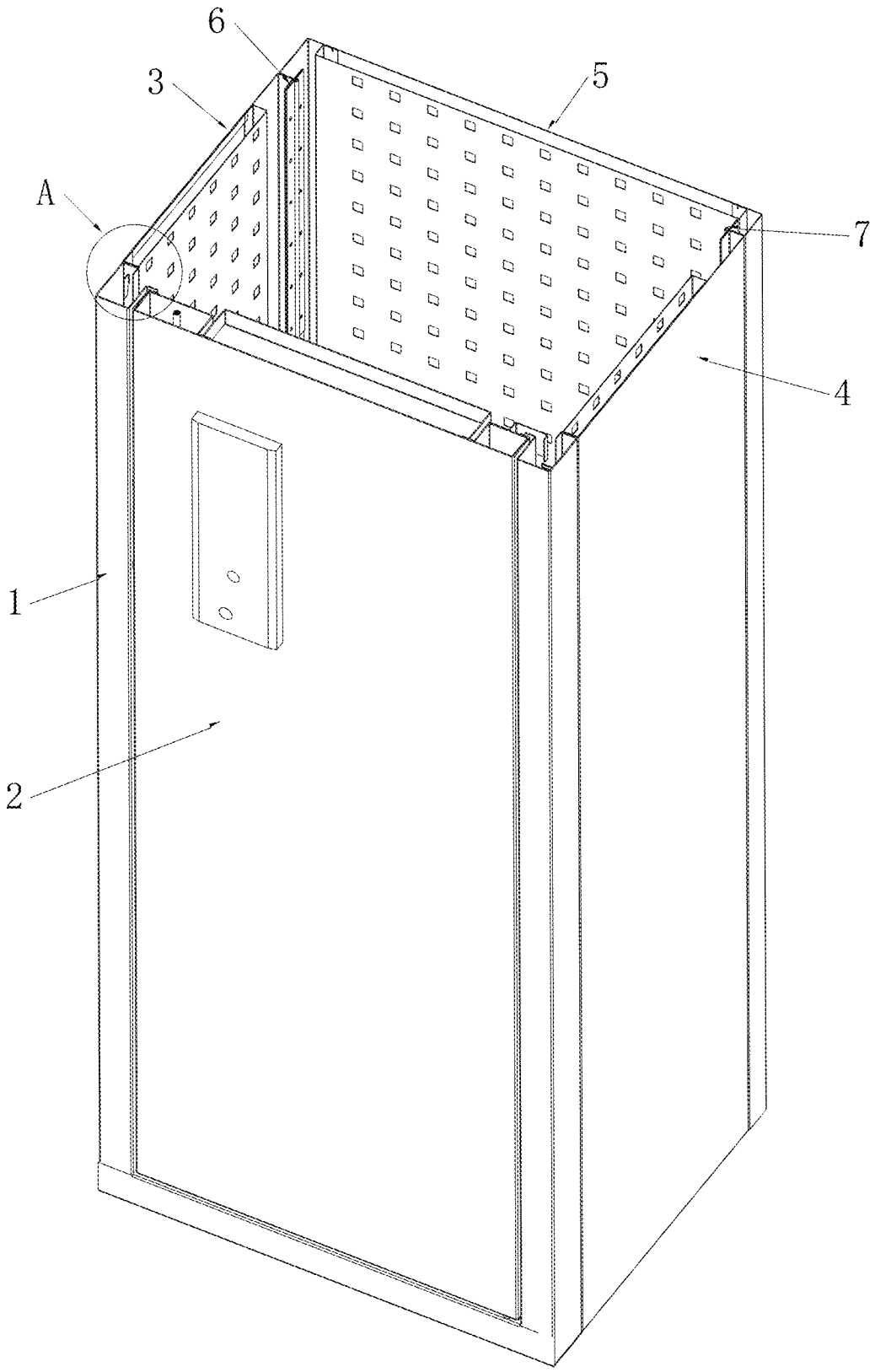
FIG. 3 is a cross-sectional view of the storage cabinet according to the present disclosure.
Figure 4:
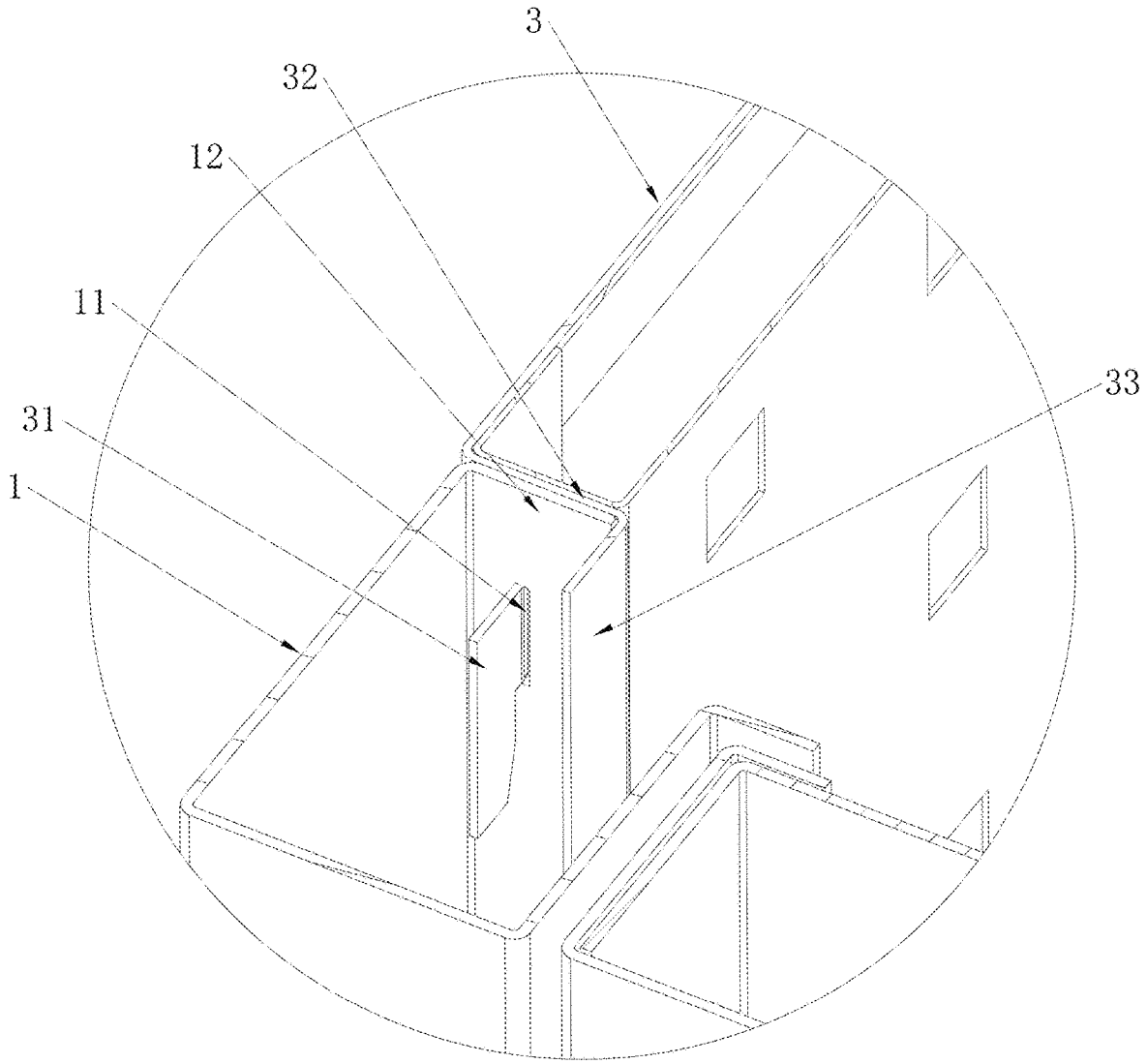
FIG. 4 is a partial enlarged view of part A in FIG. 3.

Referring to FIGS. 3 and 4, in an implementation, a front connecting plate 12 is further provided on each of the left side and the right side of a back surface of the door frame 1, and each first engagement portion 11 is located on the corresponding front connecting plate 12;

a first left connecting plate 32 is further provided on the front side of the left plate 3, and the second engagement portion 31 is located on the first left connecting plate 32; and when the left plate 3 is connected to the door frame 1, the first left connecting plate 32 is opposite to and abuts against the front connecting plate 12 located on the left side of the door frame 1. By making the first left connecting plate 32 abut against the corresponding front connecting plate 12, and also by respectively providing the first engagement portion 11 and the second engagement portion 31 engaged with each other on the corresponding front connecting plate 12 and the corresponding first left connecting plate 32, the door frame 1 and the left plate 3 can be tightly connected together, so that the connection strength can be improved, and it is also possible to prevent the formation of a gap between the door frame and the left plate.

Figure 5:
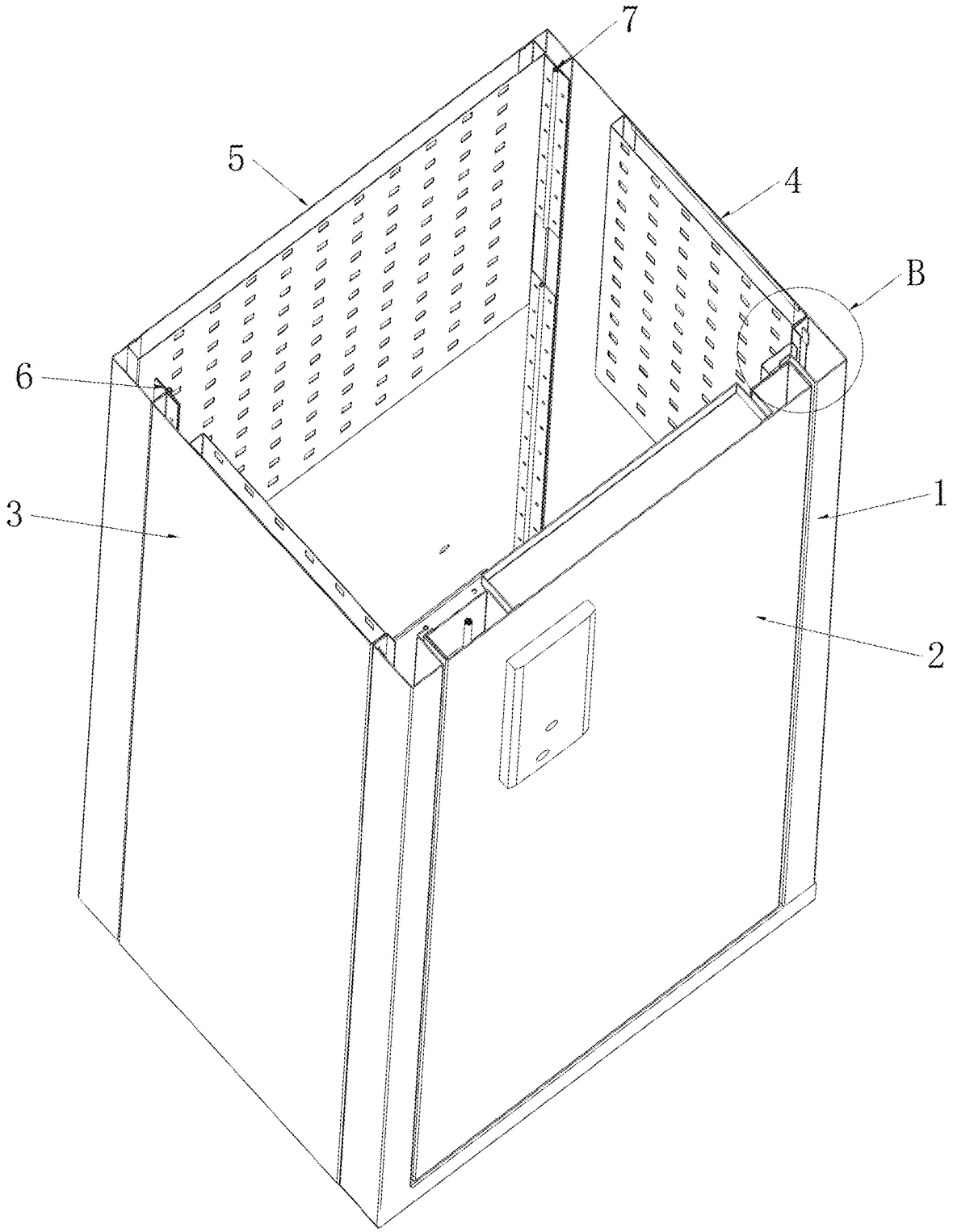
FIG. 5 is a cross-sectional view of the storage cabinet according to the present disclosure.
Figure 6:
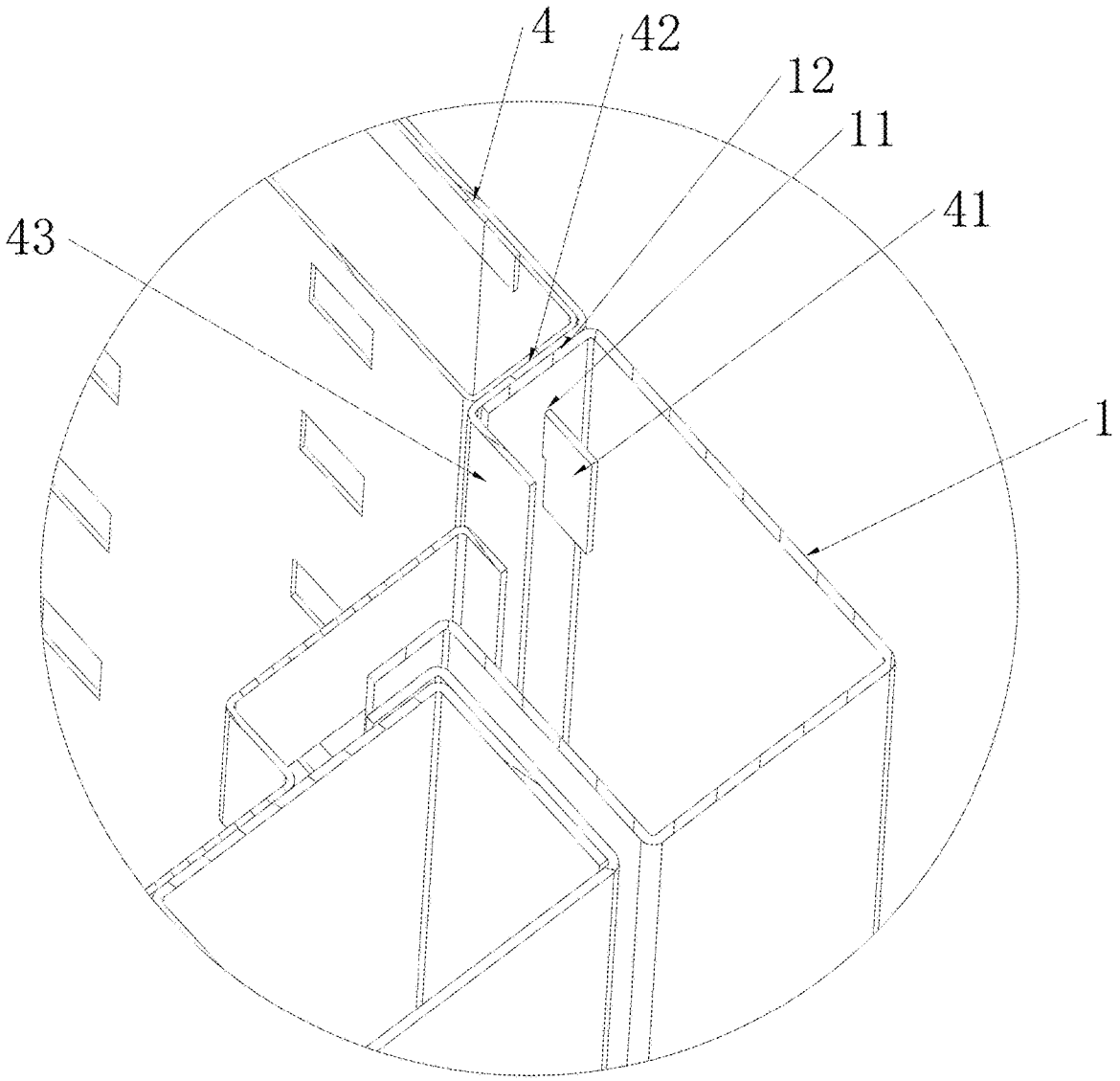
FIG. 6 is a partial enlarged view of part B in FIG. 5.

Referring to FIGS. 5 and 6, a first right connecting plate 42 is further provided on the front side of the right plate 4, and the third engagement portion 41 is located on the first right connecting plate 42; and when the right plate 4 is connected to the door frame 1, the first right connecting plate 42 is opposite to and abuts against the front connecting plate 12 located on the right side of the door frame 1. By making the first right connecting plate 42 abut against the front connecting plate 12, and also by respectively providing the first engagement portion 11 and the third engagement portion 41 engaged with each other on the corresponding front connecting plate 12 and the corresponding first right connecting plate 42, the door frame 1 and the right plate 4 can be tightly connected together, so that the connection strength can be improved, and it is also possible to prevent the formation of a gap between the door frame and the right plate.

Referring to FIGS. 3 and 4, in an implementation, a first extension plate 33 is further provided on the front side of the left plate 3, a first end of the first extension plate 33 is provided on an end of the first left connecting plate 32 facing away from the left plate 3, and a second end of the first extension plate 33 extends in a direction approaching the door frame 1. By providing the first extension plate 33, the structural strength of the first left connecting plate 32 can be enhanced to make the first left connecting plate 32 not easily deformed, it is thus ensured that the first left connecting plate 32 can reliably abut against the corresponding front connecting plate 12, and the structural stability is higher.

Referring to FIGS. 5 and 6, in an implementation, a second extension plate 43 is further provided on the front side of the right plate 4, a first end of the second extension plate 43 is provided on an end of the first right connecting plate 42 facing away from the right plate 4, and a second end of the second extension plate 43 extends in a direction approaching the door frame 1. By providing the second extension plate 43, the structural strength of the first right connecting plate 42 can be enhanced to make the first right connecting plate 42 not easily deformed, it is thus ensured that the first right connecting plate 42 can reliably abut against the corresponding front connecting plate 12, and the structural stability is higher.

Figure 7:
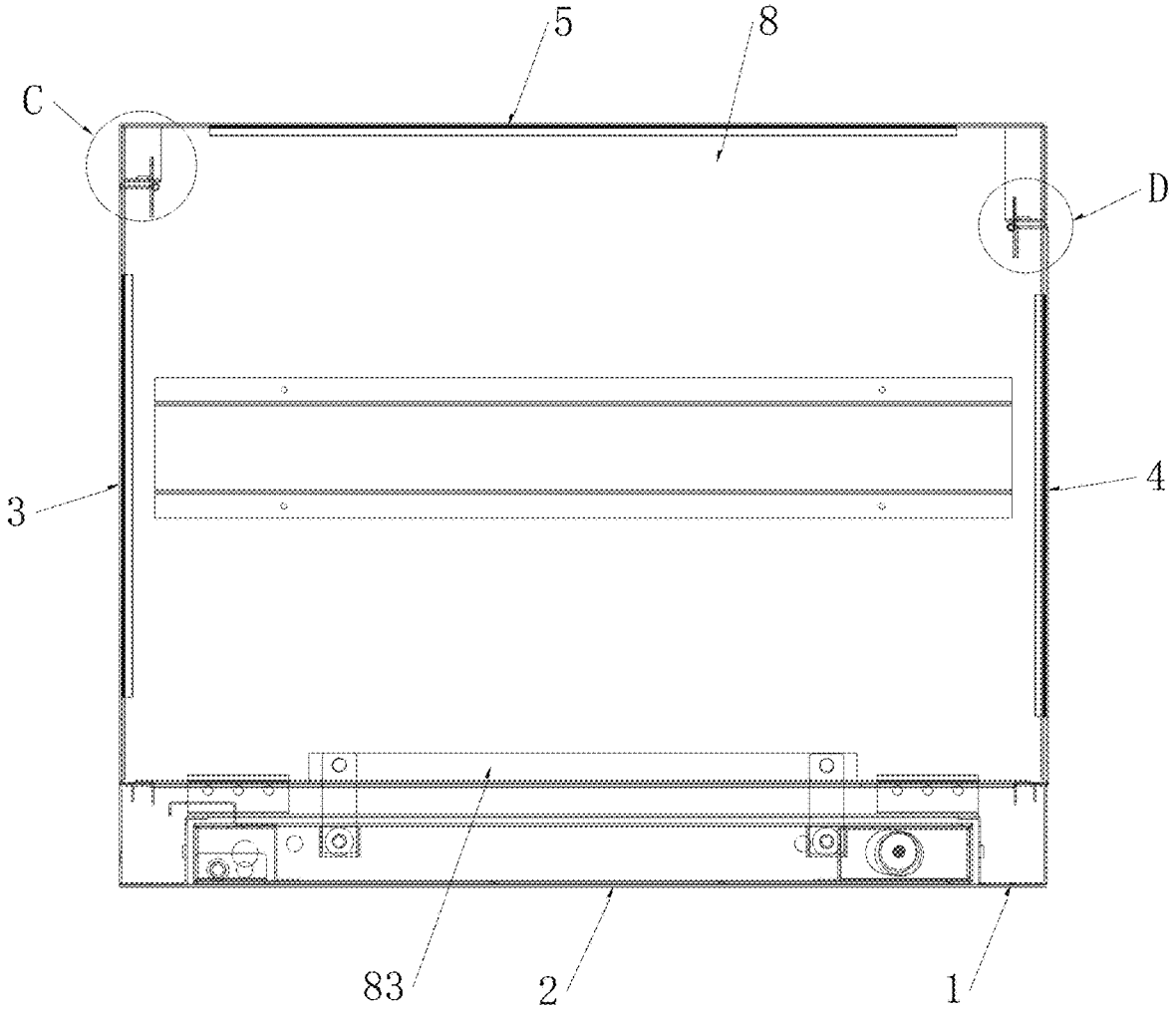
FIG. 7 is a cross-sectional view of the storage cabinet according to the present disclosure.
Figure 8:
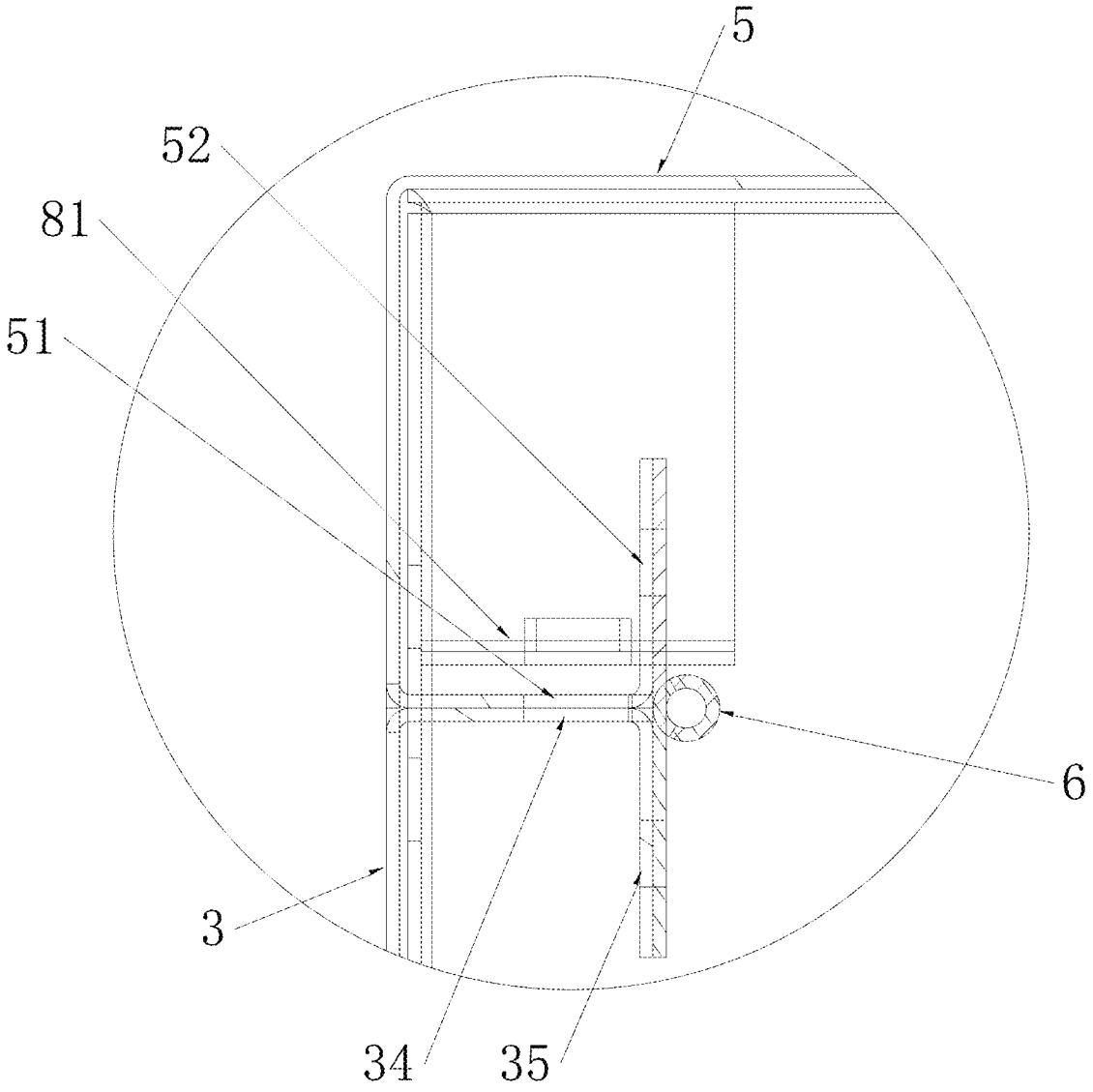
FIG. 8 is a partial enlarged view of part C in FIG. 7.

Referring to FIGS. 7 and 8, in an implementation, a second left connecting plate 34 and a third extension plate 35 are provided on the rear side of the left plate 3, the second left connecting plate 34 is perpendicular to the left plate 3, the third extension plate 35 is provided at an end of the second left connecting plate 34 remote from the left plate 3, and the third extension plate 35 is perpendicular to the second left connecting plate 34;

a first rear connecting plate 51 and a fourth extension plate 52 are provided on the left side of the rear back plate 5, the first rear connecting plate 51 is opposite to and abuts against the second left connecting plate 34, the fourth extension plate 52 is provided on the first rear connecting plate 51, and the fourth extension plate 52 and the third extension plate 35 are provided on two sides of the second left connecting plate 34 and the first rear connecting plate 51 respectively; and a first side plate of the first hinge 6 and the third extension plate 35 are opposite to each other and connected together, and a second side plate of the first hinge 6 and the fourth extension plate 52 are opposite to each other and connected together. By making the first rear connecting plate 51 abut against the second left connecting plate 34, it is possible to prevent the formation of a gap between the left plate 3 and the rear back plate 5, and also by making the first side plate of the first hinge 6 and the third extension plate 35 opposite to each other and connected together, and the second side plate of the first hinge 6 and the fourth extension plate 52 opposite to each other and connected together, it is possible to tightly connect the left plate 3 and the rear back plate 5 together, and the connection strength can be improved.

Figure 9:
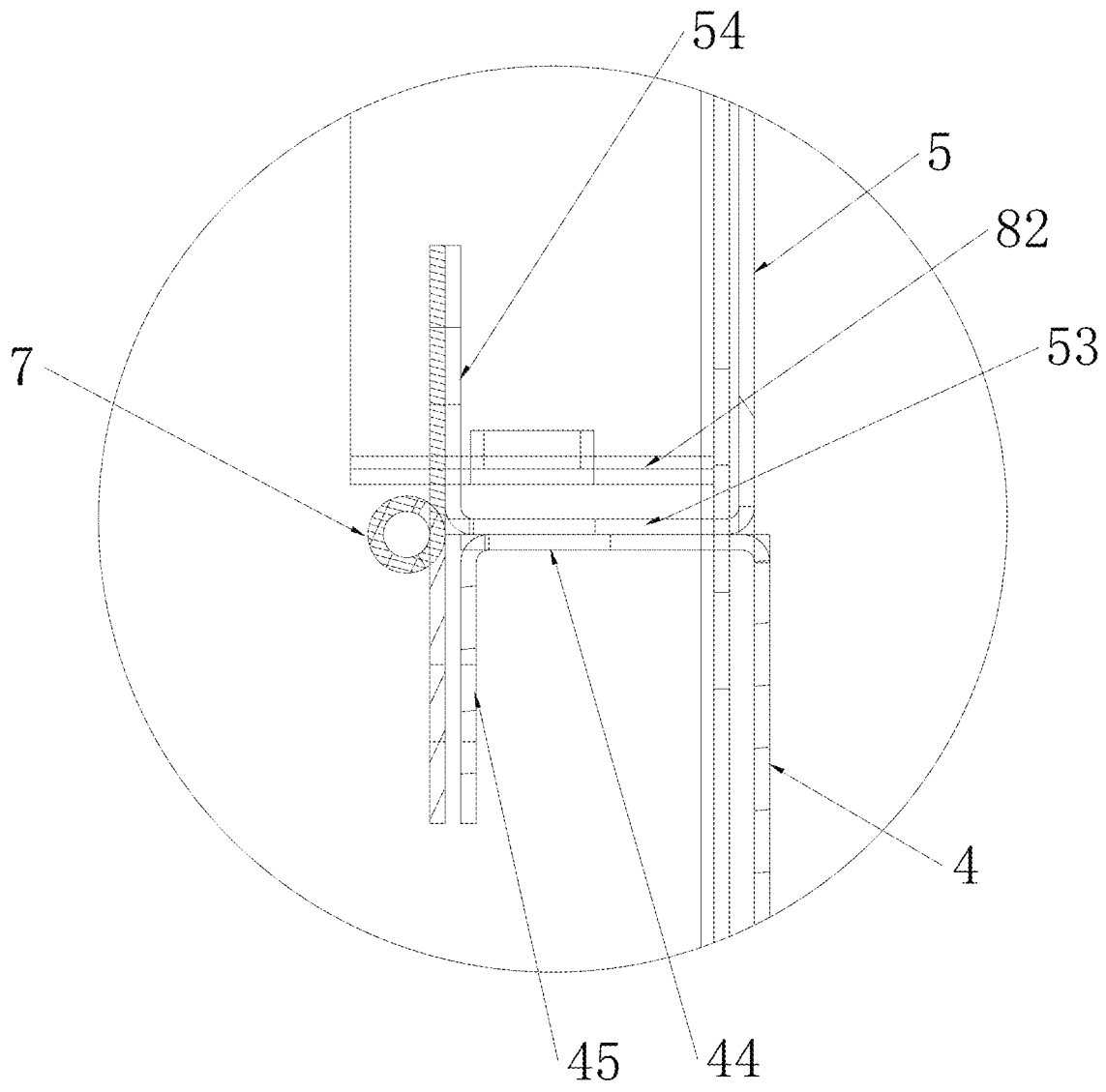
FIG. 9 is a partial enlarged view of part D in FIG. 7.

Referring to FIGS. 7 and 9, in an implementation, a second right connecting plate 44 and a fifth extension plate 45 are provided on the rear side of the right plate 4, the second right connecting plate 44 is perpendicular to the right plate 4, the fifth extension plate 45 is provided at an end of the second right connecting plate 44 remote from the right plate 4, and the fifth extension plate 45 is perpendicular to the second right connecting plate 44;

a second rear connecting plate 53 and a sixth extension plate 54 are provided on the right side of the rear back plate 5, the second rear connecting plate 53 is opposite to and abuts against the second right connecting plate 44, the sixth extension plate 54 is provided on the second rear connecting plate 53, and the sixth extension plate 54 and the fifth extension plate 45 are provided on two sides of the second right connecting plate 44 and the second rear connecting plate 53 respectively; and a first side plate of the second hinge 7 and the fifth extension plate 45 are opposite to each other and connected together, and a second side plate of the second hinge 7 and the sixth extension plate 54 are opposite to each other and connected together. By making the second rear connecting plate 53 abut against the second right connecting plate 44, it is possible to prevent the formation of a gap between the right plate 4 and the rear back plate 5, and also by making the first side plate of the second hinge 7 and the fifth extension plate 45 opposite to each other and connected together, and the second side plate of the second hinge 7 and the sixth extension plate 54 opposite to each other and connected together, it is possible to tightly connect the right plate 4 and the rear back plate 5 together, and the connection strength can be improved.

Therefore, an enclosed cabinet body can be formed, and after the top plate 8 and the bottom plate 9 are mounted on the cabinet body, a closed storage cabinet can be thus formed, so that the safety performance of the storage cabinet can be further improved, and the anti-theft performance is higher.

Referring to FIGS. 7-9, in an implementation, a plurality of first fasteners are provided;

the top plate 8 is provided with a first connecting lug 81, a second connecting lug 82, and a third connecting lug 83;

at least one first fastener connects the first connecting lug 81, the second left connecting plate 34 and the first rear connecting plate 51 together, so that the reliable connection between the top plate 8 and the cabinet body can be achieved, it is also possible to enhance the connection strength between the second left connecting plate 34 and the first rear connecting plate 51 abutting against each other, and the structural stability is higher;

at least one first fastener connects the second connecting lug 82, the second right connecting plate 44 and the second rear connecting plate 53 together, so that the reliable connection between the top plate 8 and the cabinet body can be achieved, it is also possible to enhance the connection strength between the second right connecting plate 44 and the second rear connecting plate 53 abutting against each other, and the structural stability is higher; and at least one first fastener connects the third connecting lug 83 and the door frame 1, so that the reliable connection between the top plate 8 and the cabinet body can be achieved, it is also possible to enhance the connection strength between the top plate 8 and the door frame 1, and the overall structural strength of the storage cabinet can be higher.

In the description of this specification, descriptions with reference to the terms such as "an embodiment", "some embodiments", "example", "specific example", or "some examples" mean that specific features, structures, materials, or characteristics described with reference to the embodiment or example are included in at least one embodiment or example of the present disclosure. Moreover, the specific features, structures, materials or characteristics described can be combined in any one or more embodiments or examples in any suitable manner. In addition, without any contradiction, those skilled in the art may incorporate and combine different embodiments or examples and features of the different embodiments or examples described in this specification.

In addition, the terms "first" and "second" are used for descriptive purposes only, and cannot be construed as indicating or implying relative importance or implicitly indicating the number of technical features indicated. Thus, the features defined with "first" and "second" may explicitly or implicitly include at least one of the features. In the description of the present disclosure, the meaning of "a plurality of" is two or more, unless explicitly and specifically defined otherwise.

The above descriptions are merely specific implementations of the present disclosure, but are not intended to limit the scope of protection of the present disclosure. Any variation or replacement readily figured out by those skilled in the art within the technical scope disclosed in the present disclosure shall fall within the scope of protection of the present disclosure. Therefore, the scope of protection of the present disclosure shall be subject to the scope of protection of the claims.

The invention claimed is:

1. A storage cabinet, comprising:

a door frame, a first engagement portion being provided on each of a left side and a right side of the door frame;

a cabinet door, the cabinet door being rotatably provided on the door frame;

a left plate, a second engagement portion being provided on a front side of the left plate, and the second engagement portion being engaged with the first engagement portion on the left side of the door frame so as to connect the left plate to the door frame;

a right plate, a third engagement portion being provided on a front side of the right plate, and the third engagement portion being engaged with the first engagement portion on the right side of the door frame so as to connect the right plate to the door frame;

a rear back plate, the rear back plate being located between a rear side of the left plate and a rear side of the right plate, a left side of the rear back plate and the rear side of the left plate being connected together by means of a first hinge, a right side of the rear back plate and the rear side of the right plate being connected together by means of a second hinge, and the rear back plate, the left plate, the right plate, the cabinet door and the door frame enclosing a cabinet body;

a top plate, the top plate being located in a top opening of the cabinet body and closing the top opening, and the top plate being connected to the cabinet body by means of a first fastener; and a bottom plate, the bottom plate being located in a bottom opening of the cabinet body and closing the bottom opening, and the bottom plate being connected to the cabinet body by means of a second fastener;

wherein a front connecting plate is further provided on each of the left side and the right side of a back surface of the door frame, and each first engagement portion is located on the corresponding front connecting plate;

a first left connecting plate is further provided on the front side of the left plate, and the second engagement portion is located on the first left connecting plate;

when the left plate is connected to the door frame, the first left connecting plate is opposite to and abuts against the front connecting plate located on the left side of the door frame;

a first right connecting plate is further provided on the front side of the right plate, and the third engagement portion is located on the first right connecting plate; and when the right plate is connected to the door frame, the first right connecting plate is opposite to and abuts against the front connecting plate located on the right side of the door frame.

2. The storage cabinet according to claim 1, wherein the bottom plate and the rear back plate are connected together by means of a third hinge.

3. The storage cabinet according to claim 2, wherein the third hinge is located outside the cabinet body such that the bottom plate is capable of being turned in a direction approaching an inner side surface of the rear back plate; and a limiting pallet is provided at the bottom of the cabinet body and is disposed opposite to the third hinge, the limiting pallet supports an end of the bottom plate facing away from the third hinge, and the limiting pallet is connected to the bottom plate by means of the second fastener.

4. The storage cabinet according to claim 1, wherein the first hinge and the second hinge are both located inside the cabinet body such that both the left plate and the right plate are capable of being turned in a direction approaching an inner side surface of the rear back plate.

5. The storage cabinet according to claim 1, wherein a first extension plate is further provided on the front side of the left plate, a first end of the first extension plate is provided on an end of the first left connecting plate facing away from the left plate, and a second end of the first extension plate extends in a direction approaching the door frame.

6. The storage cabinet according to claim 5, wherein a second extension plate is further provided on the front side of the right plate, a first end of the second extension plate is provided on an end of the first right connecting plate facing away from the right plate, and a second end of the second extension plate extends in a direction approaching the door frame.

7. The storage cabinet according to claim 1, wherein the rear side of the left plate is provided with a second left connecting plate and a third extension plate, the second left connecting plate is perpendicular to the left plate, the third extension plate is provided on an end of the second left connecting plate remote from the left plate, and the third extension plate is perpendicular to the second left connecting plate;

a first rear connecting plate and a fourth extension plate are provided on the left side of the rear back plate, the first rear connecting plate is opposite to and abuts against the second left connecting plate, the fourth extension plate is provided on the first rear connecting plate, and the fourth extension plate and the third extension plate are provided on two sides of the second left connecting plate and the first rear connecting plate respectively; and a first side plate of the first hinge and the third extension plate are opposite to each other and connected together, and a second side plate of the first hinge and the fourth extension plate are opposite to each other and connected together.

8. The storage cabinet according to claim 7, wherein a second right connecting plate and a fifth extension plate are provided on the rear side of the right plate, the second right connecting plate is perpendicular to the right plate, the fifth extension plate is provided at an end of the second right connecting plate remote from the right plate, and the fifth extension plate is perpendicular to the second right connecting plate;

a second rear connecting plate and a sixth extension plate are provided on the right side of the rear back plate, the second rear connecting plate is opposite to and abuts against the second right connecting plate, the sixth extension plate is provided on the second rear connecting plate, and the sixth extension plate and the fifth extension plate are provided on two sides of the second right connecting plate and the second rear connecting plate respectively; and a first side plate of the second hinge and the fifth extension plate are opposite to each other and connected together, and a second side plate of the second hinge and the sixth extension plate are opposite to each other and connected together.

9. The storage cabinet according to claim 8, wherein a plurality of first fasteners are provided;

the top plate is provided with a first connecting lug, a second connecting lug, and a third connecting lug;

at least one of the first fasteners connects the first connecting lug, the second left connecting plate and the first rear connecting plate together;

at least one of the first fasteners connects the second connecting lug, the second right connecting plate and the second rear connecting plate together; and at least one of the first fasteners connects the third connecting lug and the door frame together.

* * * * *